United States Patent [19]

Cordery

[11] Patent Number: 4,849,736

[45] Date of Patent: Jul. 18, 1989

[54] MAGNETIC MARKER HAVING A RECTANGULAR CONFIGURATION FOR ELECTRONIC ARTICLE SURVEILLANCE

[75] Inventor: Robert A. Cordery, Danbury, Conn.

[73] Assignee: Pitney Bowes Inc., Stamford, Conn.

[21] Appl. No.: 132,085

[22] Filed: Dec. 11, 1987

[51] Int. Cl.[4] ..... G08B 13/24

[52] U.S. Cl. ..... 340/551; 340/572

[58] Field of Search ..... 340/572, 551

[56] References Cited

U.S. PATENT DOCUMENTS 4,222,517 9/1980 Richardson ..... 340/572 X 4,280,863 7/1981 Hamisch, Jr. et al. ..... 156/387

4,710,754 12/1987 Montean ..... 340/572

*Primary Examiner*—Glen R. Swann, III

*Assistant Examiner*—Thomas J. Mullen, Jr.

*Attorney, Agent, or Firm*—Peter Vrahotes; Melvin J. Scolnick; David E. Pitchenik

[57] ABSTRACT

A magnetic marker is disclosed having characteristics that lend the marker to being useful in the field of theft detection using electronic article surveillance techniques. The marker has a magnetic member that is formed in a rectangular configuration. With such configuration one is able to fabricate magnetic markers of relatively small sizes.

16 Claims, 1 Drawing Sheet

MAGNETIC MARKER HAVING A RECTANGULAR CONFIGURATION FOR ELECTRONIC ARTICLE SURVEILLANCE

BACKGOUND OF THE INVENTION

A longstanding problem has existed in attempting to prevent the theft of articles from retail stores and the like. One scheme that has been used with various degrees of success is electronic article surveillance (EAS) wherein a detectable marker is secured to an article to be protected. Such markers are shown and described in French Patent Application No. 763,681 to M. Picard. The marker responds to an interrogation signal from a transmitting apparatus situated either at the exit door of the premises to be protected, or at the aisle way adjacent to the cashier or checkout stand. Receiving coils, located on opposite sides of the exit or aisle way from the transmitting marker, receive a signal produced by the marker in response to the interrogation signal. The presence of the response signal indicates that the marker has not been removed or deactivated by the cashier, and that there may not have been payment for the article.

Various types of markers have been used to prevent theft. One type of marker is referred to as a radio frequency marker wherein a conductive coil is sandwiched between two layers of relatively hard material. Normally these markers are affixed to an article and must be removed manually by a cashier upon an article being purchased. The cashier is equipped with a device for removing such a marker without damaging the article to which the marker is attached. Another type of marker uses magnetic material for the purpose of detection. A magnetic marker comprises a soft magnetic material sandwiched between two attached layers of a dielectric material such as paper or plastic. This type of marker is normally disposable and is attached to an article with pressure sensitive adhesive, or it may be incorporated within the article itself.

The drawback of prior commerical markers, whether they be RF markers or magnetic markers, is that each has to be applied to an article manually. Attempts have been made in the past to fabricate a device that would allow one to apply markers to an article by machine, but these devices have been much too cumbersome due to the relatively large sizes of such markers. There are commercially available labellers, such as the Monarch Model 1110® Labeller and the like available from Monarch Marking Systems, Dayton, Ohio, that apply labels in a rapid fashion to articles such as boxes, cans, books, and the like. It would be advantageous if one were able to make a marker sufficiently small so that one could make a label roll of markers that would be received within a labeller so that markers could be applied mechanically in a rapid fashion.

SUMMARY OF THE INVENTION

It has been found that forming a soft magnetic material in a rectangular configuration results in a marker of small dimensions yet readily detectable. Whereas prior markers had soft magnetic strips that are either singularly received within a marker, or had two strips layed side by side, parallel to one another. In order for such longitudinal strips to be detectable, they were required to have a length of at least two inches. By having the soft magnetic marker in a rectilinear configuration, it has been discovered that a substantially smaller marker can be produced that is readily detectable.

DETAILED DESCRIPTION OF THE PREFERRED EMBODIMENTS

Figure 1:
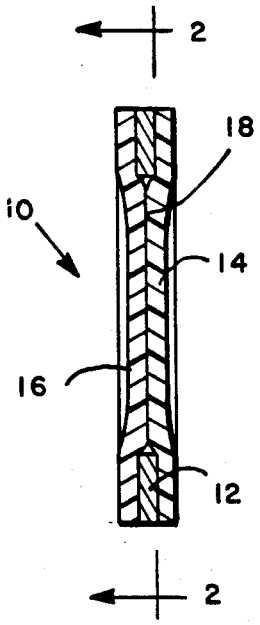
FIG. 1 shows a longitudinal cross sectional view of a marker that incorporates the instant invention.
Figure 2:
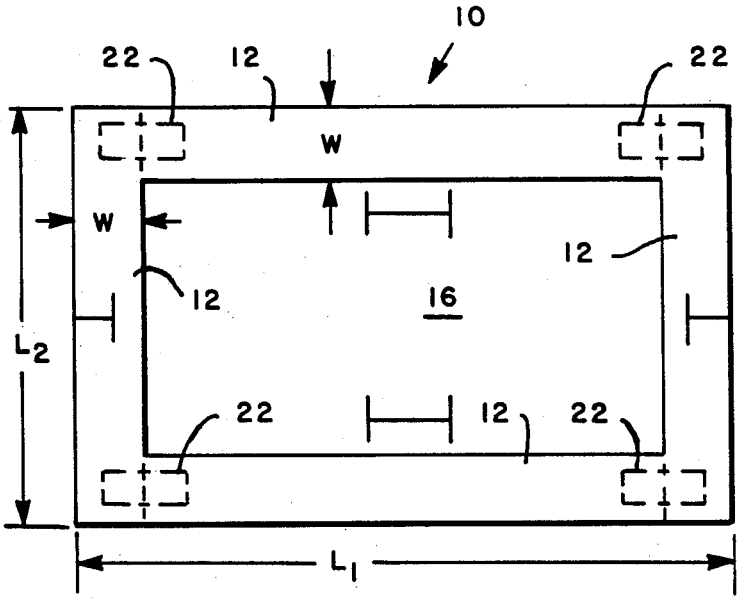
FIG. 2 shows a plan view of the marker of FIG. 1 taken along the lines 22.

With reference initially to FIGS. 1 and 2, a marker is shown generally at 10 and includes a soft magnetic material 12 of high permeability in a rectangular frame having linear sides form. Examples of such soft magnetic materials are permalloy and amorphous metals. The soft magnetic material 12 is located between planar surfaces of an upper dielectric sheet 14 and a lower dielectric sheet 16. These dielectric sheets 14,16 may be paper, plastic and the like. These two sheets 14,16 are connected by an adhesive 18, such as glue that is applied to at least one of the planar surfaces thereof so as to sandwich the magnetic material 12 therebetween. One of the sheets 14,16 can have adhesive applied to its exterior planar surface so that the marker 10 can be applied to an article.

With reference to FIG. 2, the magnetic material 12 can be made from a monolithic sheet so as to be continuously formed, or it may be made of four separate strips as indicated by dotted lines in FIG. 2. When formed from four strips, they may either be placed upon one of the sheets one at a time and then covered by the other sheet, or they may be joined together by adhesive tape 22 before being sandwiched between the sheets 14,16.

It has been found that a rectangular frame configuration having one side with length $L_1$ of approximately 1.2 inches, the other side having a length $L_2$ of approximately 0.8 inches and the strip having a width W of approximately 0.125" is preferable. Such a marker, when placed within an interrogation zone of two to ten oersteds and at 9 kilohertz has been readily detected at a distance of four feet. Another configuration that has been found acceptable is a generally square configuration. The soft magnetic material should be as thin as practical, the present limit being approximately 20 micrometers.

Although the invention has been described as a rectangular member 12 sandwiched between two sheets 14,16, it will be appreciated that one of the sheets 16 can be eliminated and the resulting combination of sheet 14 with adhesive 18 and magnetic material 12 may be applied directly to an article with the magnetic member in contact with the article.

This new configuration of soft magnetic material in an EAS tag results in substantially improved performance, both in signal size and in tag orientation sensitivity. The magnetic field applied to a magnetic sensitive material such as permalloy or amorphous metal results in a signal which is substantially reduced because of the magnetic charge induced on the surface. The effect of the reduced signal due to induced charge can be obviated by giving the charge room to expand. The configuration of the magnetic material shown in FIGS. 1 and 2 achieves this result. Although the length of the marker 10 is reduced, the surface area of the magnetic material is increased thereby providing more opportunity for the induced charge to spread. Futhermore, improved sensitivity relative to the orientation of the marker 10 in the interrogation zone is achieved as opposed to markers incorporating linear magnetic strips. This is achieved because a rectangular configuration is geometrically symmetrical.

Figure 3:
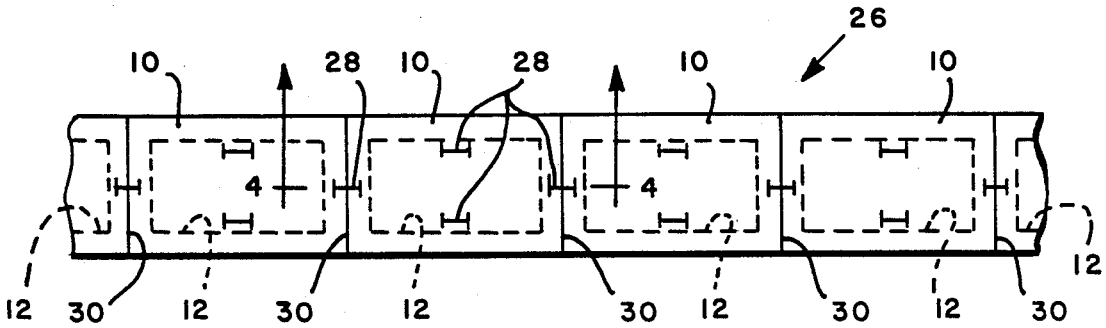
FIG. 3 shows a plan view of a composite web having labels that incorporate the instant invention.
Figure 4:
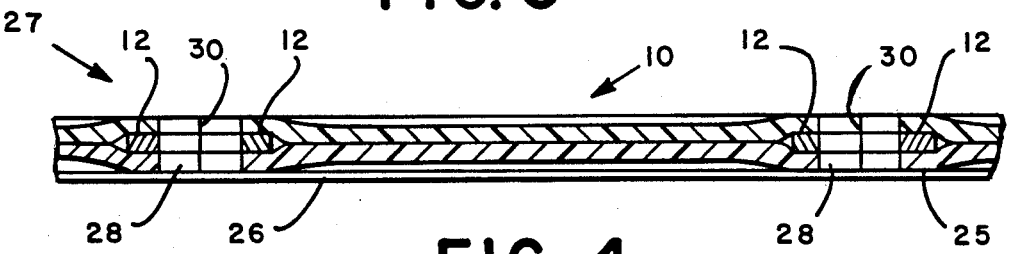
FIG. 4 is a cross section view of a composite web taken along the lines 4—4 of FIG. 3, and, FIG. 5 is a side view of the composite web shown in FIG. 4 formed in a roll.
Figure 5:
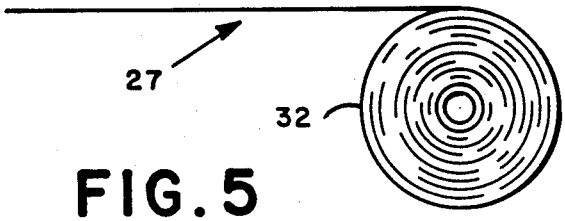

With such a magnetic marker, one is able to make a plurality of markers, place them on a carrier web and form them into a roll, as seen in FIGS. 3 to 5, so as to be manually applied by a mechanism such as a labeller.

With reference to FIGS. 3 and 4, magnetic markers 10 are shown as part of a composite web. The term composite web defines a carrier web having labels releasably secured thereto. The markers 10 are releasably secured to a carrier web 26 by an adhesive 25 to form a composite web 27. The carrier web 26 is preferably made of paper and has cuts 28 therein for receiving the teeth of a labeller drive roller. The markers 10 abut one another at 30 so as to be peeled from the carrier web 26 when directed about a peeling edge. With reference to FIG. 5, the composite web 27 was formed into a roll 32 and inserted into an 1170® Labeller. Further details relative to the 1170® Labeller and composite webs can be found in U.S. Pat. No. 4,280,863 entitled Label Printing And Applying Apparatus.

What is claimed is:

1. A magnetic marker for use in an article surveillance system comprising:

a soft magnetic member having a rectangular frame configuration with linear sides, said magnetic member being sandwiched between the faces of two dielectric sheets, each of the sheets having planar dimensions greater than the dimensions of said magnetic member, and said sheets being joined together at the ends thereof to hold said magnetic member therebetween.

2. The magnetic marker of claim 1 wherein said rectangular frame configuration is generally square.

3. The magnetic marker of claim 1 wherein said rectangular frame soft magnetic member has one pair of opposite sides approximately one third larger than the other pair of opposite sides.

4. The magnetic marker of claim 1 wherein each side of said rectangular frame configuration has a length between 0.8 and 1.2 inches, and a width of up to 0.200 inches.

5. The magnetic marker of claim 1 wherein said soft magnetic member is monolithic.

6. The magnetic marker of claim 1 wherein said soft magnetic member is formed from four strips of magnetic material attached to one another.

7. The magnetic marker of claim 6 wherein said magnetic material is permalloy.

8. The magnetic marker of claim 6 wherein said magnetic material is amorphous metal.

9. A magnetic marker for use in an article surveillance system comprising:

a soft magnetic member having a rectangular frame configuration with linear sides, and a sheet having adhesive on one planar surface thereof, said magnetic member being in contact with said adhesive.

10. The magnetic marker of claim 9 wherein said rectangular frame configuration is generally square.

11. The magnetic marker of claim 9 wherein said rectangular frame soft magnetic member has one pair of opposite sides approximately one third larger than the other pair of opposite sides.

12. The magnetic marker of claim 9 wherein each side of said rectangular configuration has a length between 0.8 and 1.2 inches, and a width of up to 0.200 inches.

13. The magnetic marker of claim 9 wherein said rectangular soft magnetic member is monolithic.

14. A composite web for use in an article surveillance system comprising:

a plurality of soft magnetic members, said soft magnetic members being in rectangular frame form with linear sides and sandwiched between the faces of two dielectric sheets, each of the sheets having planar dimensions greater than the dimensions of said soft magnetic members, said sheets being joined together to sandwich said soft magnetic members therebetween so as to form labels, said labels being releaseably attached to a carrier web to form a composite web.

15. The composite web of claim 14 wherein each side of said rectangular frame configuration has a length between 0.8 and 1.2 inches, and a width of less than 0.200 inches inclusive.

16. The composite web of claim 14 wherein said carrier web has cuts therein.

* * * * *